US007558697B2

(12) United States Patent
Anderson

(10) Patent No.: US 7,558,697 B2
(45) Date of Patent: Jul. 7, 2009

(54) CALENDAR FOR ELECTRONIC DEVICE

(75) Inventor: John Anderson, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 11/498,908

(22) Filed: Aug. 3, 2006

(65) Prior Publication Data

US 2008/0040072 A1 Feb. 14, 2008

(51) Int. Cl.
*G04G 5/00* (2006.01)
*G04G 7/00* (2006.01)

(52) U.S. Cl. ..... 702/178

(58) Field of Classification Search ..... 702/178; 715/751, 963
See application file for complete search history.

(56) References Cited

U.S. PATENT DOCUMENTS

| | | | | |
|---|---|---|---|---|
| 5,963,913 | A * | 10/1999 | Henneuse et al. | 705/9 |
| 2002/0191035 | A1 * | 12/2002 | Selent | 345/866 |
| 2004/0044646 | A1 * | 3/2004 | Hullot et al. | 707/1 |
| 2004/0109025 | A1 * | 6/2004 | Hullot et al. | 345/764 |
| 2005/0215310 | A1 * | 9/2005 | Boyd et al. | 463/20 |
| 2005/0262164 | A1 * | 11/2005 | Guiheneuf et al. | 707/203 |
| 2006/0190313 | A1 * | 8/2006 | Lu | 705/8 |

* cited by examiner

*Primary Examiner*—Michael P Nghiem
(74) *Attorney, Agent, or Firm*—Fish & Richardson P.C.

(57) ABSTRACT

A calendar for an electronic device includes suitable programming so that the calendar is displayed on two or more electronic devices, such as computers. Programming of the calendar is operable so that when someone at one of the electronic devices alters a calendar item, an animation corresponding to such alteration is displayed on the calendar displayed at another one of the electronic devices.

16 Claims, 2 Drawing Sheets

CALENDAR FOR ELECTRONIC DEVICE

FIELD

This invention relates to an electronic calendar.

BACKGROUND

The coordination of the schedules of an individual or a group of people is aided by calendars. In typical fashion, such calendars include various meetings, alerts, reminders, etc.

Calendars for electronic devices (referred to as "electronic calendars") are generally implemented using a suitable microprocessor and associated programming. Electronic calendars are generally displayed on an associated display device such as the screen of a computer, PDA, cell phone, music player, or other suitable electronic device. Items for the calendar, such as reminders, calendar events, or meetings, can be inputted or entered into the electronic calendar by any suitable input device or mechanism, whether by touch screen, keyboard, pointer, mouse, touchpad, stylus, etc.

The electronic calendar and associated items scheduled thereon are generally selectively displayed in any number of formats, whether daily, weekly or monthly, and can be displayed in association with other tools, such as task lists, note pads, or an electronic mailbox.

One of the challenges with electronic calendars is coordinating the calendars and associated schedules of two or more users. Methods and associated programming for such schedule coordination are sometimes cumbersome, difficult to use, and thereby result in miscommunication between individuals or even missed appointments.

SUMMARY

The details of one or more embodiments of the invention are set forth in the accompanying drawings and the description below. Other features, objects, and advantages of the invention will be apparent from the description and drawings, and from the claims.

An electronic calendar allows calendar items, such as reminders or events, to be inputted and displayed on two or more electronic devices. Suitable programming allows a calendar item to be added, deleted or altered in response to user input at one of the devices. A visual depiction of such operation is displayed on another associated device. In one implementation, the visual depiction takes the form of an animation.

DETAILED DESCRIPTION

Figure 1:
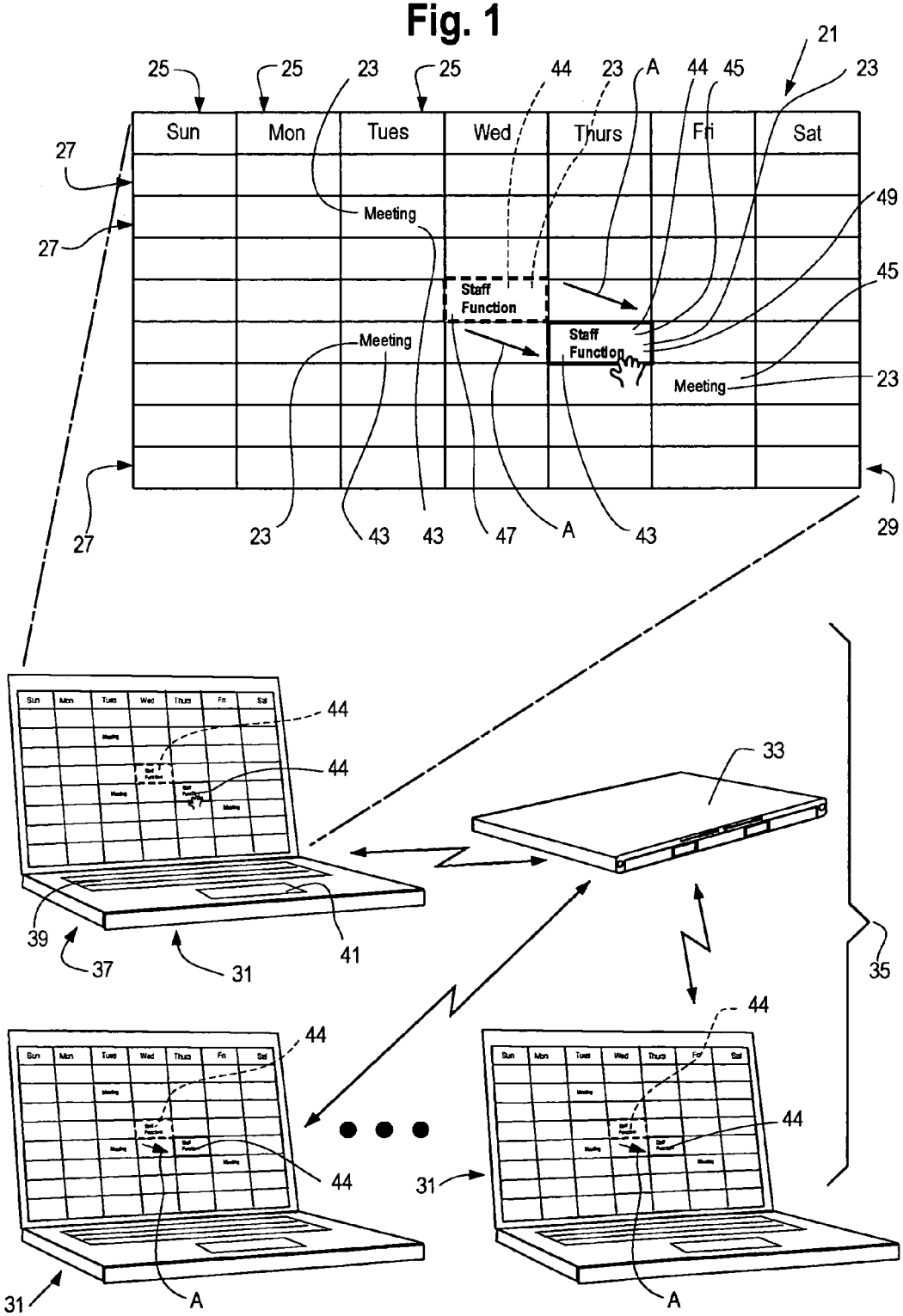
FIG. 1 is a schematic diagram of one possible implementation of an electronic calendar, according to one aspect of the present invention.

One of the many possible implementations of an electronic calendar according to the present invention is shown in FIG. 1. As explained below, electronic calendar 21 includes suitable programming not only to permit a calendar item to be added, deleted, or changed at one computer, but also to show calendar alteration by a visual depiction, such as an animation on another computer. The visual depiction is shown when calendar 21 is displayed on the other "target" computer, either as the calendar alteration is occurring or subsequent thereto.

Calendar 21 includes calendar items 23, which have been entered or imported into an associated memory or database. The term "calendar items" is intended to broadly encompass any input, entry, or data associated with calendar 21, including calendar events like meetings, appointments, functions; or calendar reminders, such as due dates, upcoming events, actions, etc. In FIG. 1, calendar items 23 comprise calendar events 43, 44 in the form of meetings and a staff function, all of which may or may not have particular dates and times associated therewith. In the illustrated implementation, calendar items 23 are associated with particular dates and particular times.

Calendar 21 is displayed in a weekly format with dates 25 forming columns, and times 27 forming rows, so that together calendar 21 is displayed as a grid 29. Other configurations are possible. Calendar items 23 occupy boxes, blocks, or other areas on grid 29 corresponding to the date 25 and time 27 associated with the particular item 23.

Suitable programming permits calendar 21 to be displayed on two or more associated electronic devices, such as computers. The term "associated" in reference to electronic devices or computers is intended to include any access, connection, or communication capability between the devices by which the same calendar items 23 can be accessed and displayed. For example, electronic devices can be associated by being equipped with any of the multitude of networking arrangements and protocols, hardwired or wireless, transitional or dedicated, LAN, WAN, peer-to-peer, or via the worldwide web. In the example illustrated by FIG. 1, the associated electronic devices are shown as three lap-top computers 31 in a wireless network with access to server 33 to form a computer system 35. Electronic calendar 21, as implemented on computer system 35, is capable of receiving data or other inputs from users of computers 31 through keyboard 39, touch pad 41, or any other suitable input device or selection device (not shown), such as a mouse, touch screen, joy stick, voice command processor, and the like.

A user at one of the computers 31 is able to operate electronic calendar 21 to alter calendar items 23. One of the calendar items 23 in the example shown in FIG. 1 includes a calendar event 44 entitled "Staff Function." In this example, the user wishes to reschedule Staff Function 44 by making a suitable input. As shown in FIG. 1, one of the networked computers 31 (given reference number 37) is operated in response to user input to reschedule Staff Function 44 from a first date and time, shown in phantom lines in FIG. 1, to a new, rescheduled date and time shown in solid lines. When the user operates calendar 21 to alter the Staff Function 44, suitable programming animates the alteration on one or more of the other computers 31 when calendar 21 is displayed thereon.

More particularly, in one implementation, the user of computer 37 makes suitable inputs to move graphical element 45 corresponding to calendar event 44 from a first position 47 on grid 29 to a second position 49 on grid 29, in which the positions correspond to respective dates and times. In one implementation, the user selects calendar event 44 and drags it to its new position. Other selection and movement options are possible, using for example other user input devices. The above-described movement of graphical element 45 is shown visually on one or more associated or target computers. The visually depiction can, in one implementation, include an animation associated with the action. For example, a calendar event that is being moved to another date/time can be animated to show the sliding of the graphical element (e.g., graphical element 45) between two positions on the other associated computers 31. In other words, when someone alters or reschedules calendar item 23 on one computer, such altering or rescheduling is shown (e.g., animated) at another target computer in a visually perceptible way. The animation and corresponding movement is indicated by reference Arrow A in FIG. 1.

It will be appreciated that the exact form of animation ascribed to alterations to calendar 21 can be many and varied, depending on the particular application and spirit and imagination of the associated programming. Thus, for example, one basic animation displays graphical element 45 substantially continuously as it moves from its scheduled position to its rescheduled position and, during such movement, graphical element 45 can keep its same shape and appearance or otherwise remain substantially intact. Other forms of animation could include lines, streaks, or similar visual elements highlighting the movement, or could involve an alteration or "morphing" of graphical element 45 during its movement.

Although the illustrated implementation uses a visual depiction in the form of an animation, other forms of visual depiction are possible, including both animated (i.e., dynamic) and non-animated (i.e., static). In addition, animated visual depictions associated with adding a calendar item 23 could involve having the graphical element "blink" on and off or "materialize" onto grid 29 of target computers 31.

A static visual depiction could, in some implementations, include suitable graphical elements which are distinct or separate from the graphic element 45, so as to catch the eye of user(s) of the target computer(s) and communicate that a corresponding calendar operation has occurred. Color changes or related color elements are examples.

Furthermore, visual depictions can be associated not only with rescheduling as shown, but also with other alterations of calendar item 23 or operations of calendar 21. Examples of such alterations include any number of changes to meeting or event details appearing in graphical element 45, such as the attendees, location, subject, agenda, title, or information interlinking this particular calendar item with other calendar events.

A visual depiction can likewise be associated with adding or deleting a calendar item 23, such as when a user of computer 37 adds or deletes one of the calendar items 23 labeled "Meeting." Such addition or deletion could be shown on one or more target computers 31 not only by the appearance (or disappearance) of the corresponding graphical element 45, but also by the display of an associated visual depiction. Visual depictions associated with such additions or deletions to calendar 21 can include animations as discussed with reference to rescheduling of calendar items, but can also include static or non-animated visual depictions. Different visual depictions, whether static of dynamic, can be ascribed to corresponding calendar operations to provide users of target computers with visual cues of the calendar operation which occurred.

The timing of when the visual depiction (e.g., animation) appears on the target computer(s) may be varied depending on the particular calendar application, and on when the associated target computer(s) are running calendar 21 or displaying grid 29. In the illustrated implementation, calendar 21 is displayed on both target computers 31 at the time of the alteration of computer 37. In such case, the visual depiction (e.g., animation) occurs at approximately the same time as the user is altering the calendar item at computer 37 (taking into account any lag time or latency arising from the network or communication protocol). In the event a user "logs on" or otherwise accesses calendar 21 after one or more calendar items 23 have been altered by someone else, suitable programming triggers the associated visual depiction (e.g., animation) to occur on such subsequent user's electronic display after such access, either automatically when calendar 21 is accessed, or in response to a command from the subsequent user.

In one implementation, calendar 21 and its associated programming are implemented as a group calendar and as a feature of Apple's OS X SERVER operating system. As such, calendar items 23 appearing on group calendar 21 may be of interest to those users of calendar 21 with access to server 33. Group calendar 21 is likely to be accessed and displayed on multiple computers 31, and alterations to calendar items 23 by someone therefore would likewise be of interest to multiple users viewing computers 31.

The operation of calendar 21 is readily apparent from the foregoing description. Grid 29 is displayed on two or more associated computers 31. A user of one of such computers 31 wishing to alter a calendar item 23 provides a suitable input to computer 31, whether in the form of a keystroke, mouse click, command, or the like. If the alteration involves rescheduling a calendar event, suitable programming responds to user input to move graphical element 45 from a first position, corresponding to its current scheduled date and time, to a second position corresponding to its rescheduled date and time. More particularly, the user input involves operating the touchpad 41 or mouse (not shown) to select the graphical element corresponding to the calendar event, and dragging the graphical element to its new position. The alteration by someone else is visually perceived by, for example, animation at another associated computer 31 when it displays grid 29 and calendar events 23 thereon.

Figure 2:
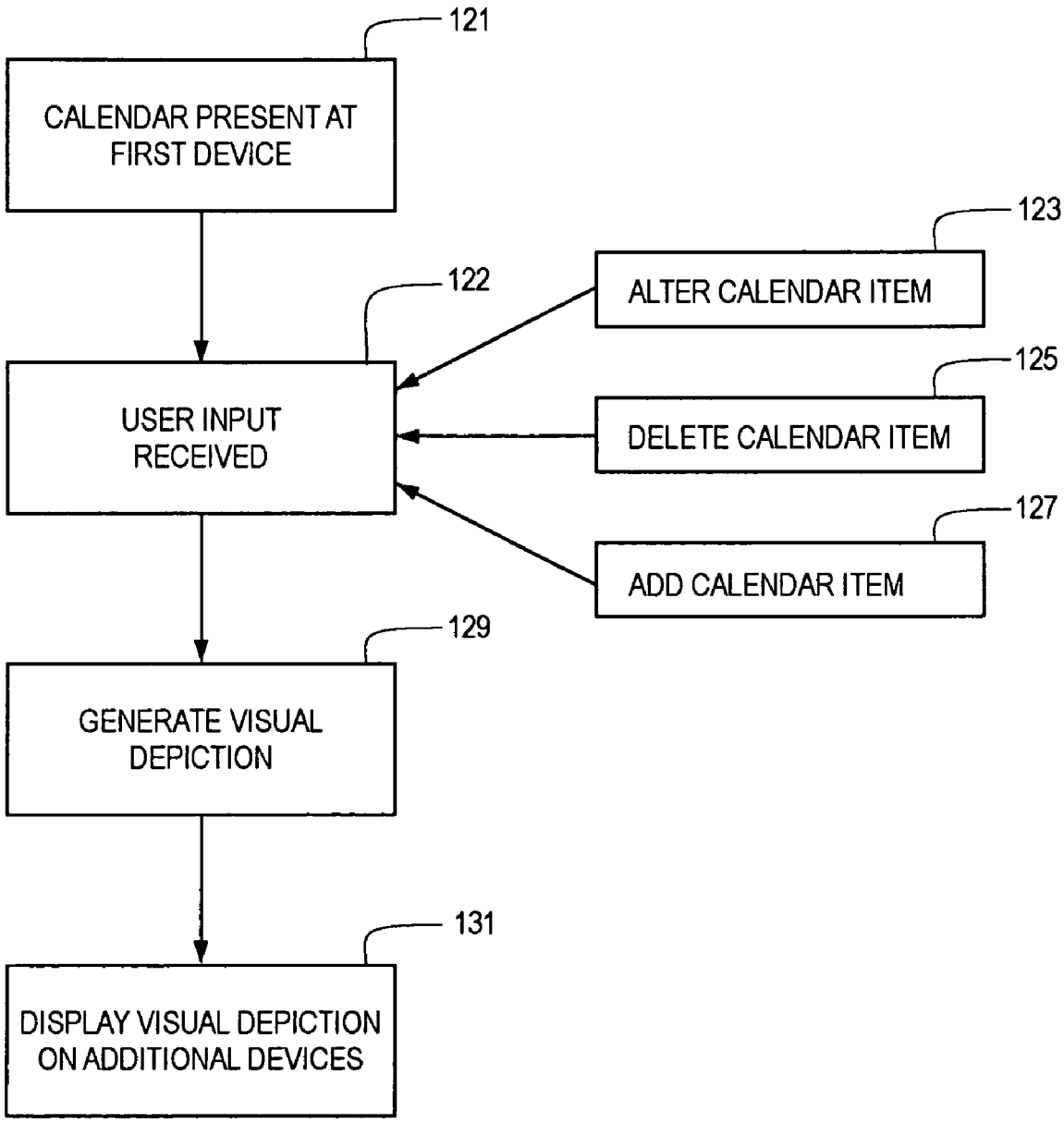
FIG. 2 is a flow chart showing one possible method of operating the electronic calendar.

The flowchart of FIG. 2 illustrates certain operations of calendar 21. A calendar is accessible by or present at a first electronic device, such as computer 37, in the illustrated implementation (block 121). Referring now to blocks 122, 123, 125, and 127, the first device receives user input, such input associated with altering a calendar item 123 (such as rescheduling), deleting a calendar item 129, or adding a calendar item 127. Referring now to block 129, calendar 21 includes suitable programming to generate a visual depiction corresponding to the calendar operations received at the first device. The visual depiction generated in block 129 is displayed on additional devices (block 131) either coincident with the calendar operation or subsequently when the calendar is displayed on additional device(s).

While FIG. 1 schematically illustrates certain embodiments of calendar 21, variations and modifications may be made to electronic calendar 21 without departing from the spirit and scope of the invention. Thus, for example, electronic calendar 21 can be implemented on any computer or electronic device capable of accessing the associated programming and displaying one or more calendar items, such as PDAs, cell phones, pocket PCs, music players, and any number of other electronic devices with suitable processing and display capabilities. It is likewise understood that use of the term "computer" is meant to capture the broadest sense of computer and include any microprocessor-equipped device, including the aforementioned electronic devices, even with limited micro processing capability, as long as calendar 21 and alterations thereto can be displayed to an end user.

Similarly, the exact location of the programming of calendar 21 can vary greatly, depending on the particular implementation. The programming can be stored locally, remotely, or a combination of the two. As such, the exact location of the programming can be made generally transparent to individual users of the associated computers 31.

As a further variation, it is not necessary that every computer or other electronic device displaying calendar 21 be capable of receiving user input to alter calendar 21. Thus, for example, certain users can have means for altering calendar items 23, while other users do not have such capability. Such restrictions can be implemented either as a function of limitations of the software and hardware itself, or by means of limiting alteration privileges to a select user or group.

The display of calendar 21 itself can likewise assume any number of forms, depending upon the desired look and feel and associated visual interface. Thus, for example, it is by no means required for grid 29 to appear as a series of rows and columns representing dates and times over a week. Daily views, monthly views, and other formats are possible. In fact, grid 29 can be dispensed with entirely in favor of other formats, such as diary pagers, notepads, and the like.

Similarly, calendar items 23, such as calendar events 43, can assume any number of forms depending on the particular look and feel desired, as well as the associated display. Graphical elements 45, shown in FIG. 1 as simple boxes, can be colored, reshaped, or otherwise customized to suit particular applications or aesthetics, or to impart additional information. In fact, graphical elements 45 can be dispensed with entirely in favor of text blocks.

Calendar 21 and its associated programming need not be a stand alone application but can be integrated with other functions and associated software. Such integration, of course, may influence how calendar 21 is displayed.

In the implementation illustrated in FIG. 1, the user of computer 37 clicks and drags calendar event 43 from its old position to its new position. However, there are any number of variations or alternatives to receiving user input to alter calendar items 23. Exact operations and manipulations associated with altering calendar items 23 will depend on any number of factors and design choices, as well as the nature of the hardware displaying calendar 21, programming choices, and programming constraints associated with such hardware or computer system 35. For example, clicking and dragging with a mouse or other selecting device may be more appropriate for traditional computer implementations, whereas highlighting and scrolling may be more appropriate for cell phone, PDA, and other more portable devices, depending on the nature of the user interface.

Although calendar 21 is in the form of a group calendar in the illustrated implementation, it will be appreciated that alternative calendar structures are possible. Thus, for example, individual calendars may be displayed on two or more associated computer displays and include the alteration functions described previously.

A number of embodiments of the invention have been described. Nevertheless, it will be understood that various modifications may be made without departing from the spirit and scope of the invention. Accordingly, other embodiments are within the scope of the following claims.

What is claimed is:

1. A method comprising:

receiving user input at a first electronic device to perform at least one of the operations of adding, altering, or deleting a calendar item at a first calendar;

displaying on a second electronic device a second calendar and a graphical element corresponding to the calendar item, where the second calendar is distinct from the first calendar and the second calendar includes the calendar item;

displaying on the second calendar on the second electronic device a visual depiction corresponding to the at least one of the operations, wherein displaying the visual depiction on the second electronic device includes displaying a graphical element corresponding to the operation which is separate from the graphical element corresponding to the calendar item; and altering the calendar item by user input at the second electronic device;

wherein the first and second electronic devices comprise computers, wherein displaying the second calendar at the second electronic device includes displaying a graphical element corresponding to the calendar item on a grid divided by date and time, and wherein altering the calendar item at the second electronic device includes selecting the graphical element and dragging the graphical element from a first position corresponding to a first date and time to a second position corresponding to a second date and time.

2. The method of claim 1, wherein displaying the visual depiction includes displaying a static, graphical element corresponding to the operation.

3. The method of claim 1, wherein displaying the visual depiction comprises displaying an animation associated with the operation.

4. The method of claim 1, wherein displaying the visual depiction includes displaying a graphical element corresponding to the operation substantially coincident with when the operation is performed on the first electronic device.

5. The method of claim 1 wherein displaying on the second electronic device comprises displaying on the second electronic device a visual depiction representative of the operation.

6. The method of claim 1 wherein displaying on the second electronic device comprises displaying on the second electronic device a visual depiction of the operation.

7. A method comprising:

displaying a calendar item on a first calendar on a first electronic device, the first calendar including the calendar item;

animating movement of the calendar item on the first calendar on the first electronic device, the animation corresponding to rescheduling of the calendar item at a second calendar at a second electronic device, where the second calendar is distinct from the first calendar and the second calendar includes the calendar item;

in which the first electronic device comprises a computer, and wherein displaying the calendar item includes displaying a graphical element corresponding to the calendar item on a grid divided by date and time; and wherein animating movement of the calendar item includes showing sliding of the graphical element from a first position corresponding to a first date and time to a second position corresponding to a second date and time.

8. The method of claim 7, wherein the animation of the movement occurs substantially at the same time as the rescheduling of the calendar item at the second electronic device.

9. The method of claim 7, wherein the animation of the movement occurs subsequent to the rescheduling of the calendar item at the second electronic device and when the calendar is displayed on the first electronic device.

10. The method of claim 7, further comprising displaying the calendar at the second electronic device and altering the calendar item by user input at the second electronic device.

11. A computer system comprising:

memory to store at least one calendar item associated with a first calendar and a second calendar, where the second calendar is distinct from the first calendar; and processing system programmed to:

display the calendar item on a first computer, the first computer having a first user interface accessible to a first user;

animate movement of the calendar item on the first calendar on the first computer as a result of rescheduling of the calendar item at the second calendar at a second computer, the second computer having a second user interface accessible to a second user;

display, on the two computers, respective graphical elements corresponding to the calendar item on respective grids associated date and time;

move the graphical element relative to the grid displayed on the second computer in response to user input; and slide the graphical element relative to the grid displayed on the first computer as a result of the graphical element being moved at the second computer.

12. The system of claim 11, further comprising a server, wherein the processing system is a component of the server, and wherein the server is accessible by the two computers.

13. The system of claim 12, wherein the processing system is programmed to slide the graphical element relative to the grid on the first computer at substantially the same time as the graphical element is moved at the second computer.

14. The system of claim 12, wherein the processing system is programmed to slide the graphical element relative to the grid on the first computer after the graphical element is moved at the second computer, and when the grid is being displayed on the first computer.

15. A first computer comprising:

a user interface to display calendar information; and a processor in communication with the user interface, the processor programmed to:

display a calendar item responsive to receiving the calendar item from a second computer, the calendar item common to both a first user calendar on the first computer and a second user calendar on the second computer, where the first user calendar is distinct from the second user calendar;

display a visual depiction of rescheduling the calendar item responsive to receiving rescheduling of the calendar item from the second computer;

display a graphical element corresponding to the calendar item on a time grid; and slide the graphical element relative to the grid on the first user calendar on the first computer responsive to the calendar item being moved at the second user calendar at the second computer.

16. The first computer of claim 15, wherein the processor is further programmed to slide the graphical element relative to the grid at substantially the same time as the graphical element is rescheduled at the second computer.

* * * * *